United States Patent [19]

Shaw

[11] 4,089,269

[45] May 16, 1978

[54] VEHICLE CONTROL SYSTEM

[75] Inventor: Raymond J. Shaw, Westboro, Mass.

[73] Assignee: Mekontrol, Incorporated, Northboro, Mass.

[21] Appl. No.: 782,236

[22] Filed: Mar. 28, 1977

[51] Int. Cl.[2] ..... B61J 3/04

[52] U.S. Cl. ..... 104/88; 250/552

[58] Field of Search ..... 104/88; 180/98; 198/349; 214/11 R; 235/61.11 E, 92 V; 246/2 R, 2 E, 2 S; 250/215, 223 R, 224, 552; 318/640; 340/146.3 K, 172.5; 343/6.5 R, 6.8 R

[56] References Cited

U.S. PATENT DOCUMENTS

| | | | |
|---|---|---|---|
| 3,744,039 | 11/1973 | Price | 250/552 |
| 3,772,523 | 11/1973 | Montanvert et al. | 250/552 |
| 3,919,527 | 11/1975 | Bowen et al. | 235/61.11 E |
| 3,988,991 | 11/1976 | Swartz | 104/88 |

*Primary Examiner*—Stephen G. Kunin

*Attorney, Agent, or Firm*—Norman S. Blodgett; Gerry A. Blodgett

[57] ABSTRACT

Vehicle control system of the retro-reflective, pattern-coding type in which the signal device is carried on the vehicle and the scanner and controls are carried beneath the supporting surface.

10 Claims, 9 Drawing Figures

VEHICLE CONTROL SYSTEM

BACKGROUND OF THE INVENTION

It is common practice to move articles from place to place within a large warehouse by use of tow trucks. It has recently been found advisable for various reasons to make these tow trucks remotely controlled. Such a system is shown in the patent of Swartz U.S. Pat. No. 3,988,991, wherein the tow truck is shown as guided along the path defined by a groove or track in the floor. At decision-making points, such as at a switch point, a scanner is buried in the floor to read a pattern code mounted on the tow truck to determine its destination and to take suitable action. Because the scanning equipment is located in the floor, the equipment of this type is constantly being rendered less than effective by the presence of dust. Not only does the dust settle on the optical elements of the scanner, but it is often necessary for the reading beam of energy to operate through a dusty atmosphere. Since the beam must pass from the scanner to the retro-reflective signal device or target on the tow truck and then return to the scanner, the length of its path is double the distance, so that the effect of the dust on the strength of the signal is very great. These and other difficulties experienced with the prior art devices have been obviated in a novel manner by the present invention.

It is, therefore, an outstanding object of the invention to provide a vehicle control system which operates effectively despite the presence of dust in the air.

Another object of this invention is the provision of a vehicle control system, including retro-reflective control equipment, in which the proper operation of the equipment can be observed without interferring with the operation of the tow truck.

A further object of the present invention is the provision of a vehicle control system, using a plurality of scanners, in which the operation of the individual scanners as well as a main control unit into which they feed can be verified externally of the equipment.

It is another object of the instant invention to provided a vehicle control equipment in which the alignment of individual scanners is set in the factory, so that not only does field installation require no alignment, but the replacement of scanners in the field is facilitated.

A still further object of the invention is the provision of a vehicle control system which is simple in construction, which is easily manufactured, and which is capable of a long life of useful service with a minimum of maintenance.

It is a further object of the invention to provide a retro-reflective control unit which is unlikely to be rendered inoperative by vibration.

With these and other objects in view, as will be apparent to those skilled in the art, the invention resides in the combination of parts set forth in the specification and covered by the claims appended hereto.

SUMMARY OF THE INVENTION

In general, the present invention has to do with a control system for tow trucks or the like making use of a retro-reflective system. The truck or vehicle is movable over a floor and a cover is fixedly mounted on the receptacle, the cover having three accurately-located apertures. The sensor, including a housing, is mounted on the undersurface of the cover and lies within the receptacle. The sensor includes a lense mounted with its axis in line with one of the apertures. The sensor housing has two apertures which cooperate with the other two apertures in the cover for the purpose of mounting. A generator is mounted in the sensor housing and provides a modulated light beam with a frequency at the infra-red end of the spectrum, which beam emerges from the lense.

More specifically, the said one of the apertures from which the beam emerges is a circular hole with a conical countersink on the undersurface of the cover. The light beam is infra-red in nature and the generator produces it by solid state circuitry operating with a light-emitting diode. The generator includes an amplifier serving the light-emitting diode and the sensor also includes a photo-transistor. The amplifier and the photo-resistor are connected to a reference oscillator to form a phase-locked loop.

BRIEF DESRIPTION OF THE DRAWINGS

The character of the invention, however, may be best understood by reference to one of its structural forms, as illustrated by the accompanying drawings, in which:

FIG. 1 is a vertical sectional view of a warehouse showing a vehicle control system, incorporating the principles of the present invention, in use with a tow truck, FIG. 2 is a perspective view with portions broken away of a signal device mounted on the tow truck, FIG. 3 is a vertical sectional view of the signal device taken on the line III—III of FIG. 2, FIG. 4 is a vertical sectional view of the control unit, FIG. 5 is a plan view of the control unit, FIG. 6 is a vertical sectional view of a sensor which forms part of the control unit, FIG. 7 is an electrical schematic diagram of a generator which forms part of the sensor, FIG. 8 is an electrical schematic diagram of a one-shot logic circuit, and FIG. 9 is an electrical schematic diagram of an amplifier which forms part of the control unit.

DESCRIPTION OF THE PREFERRED EMBODIMENT

Figure 1:
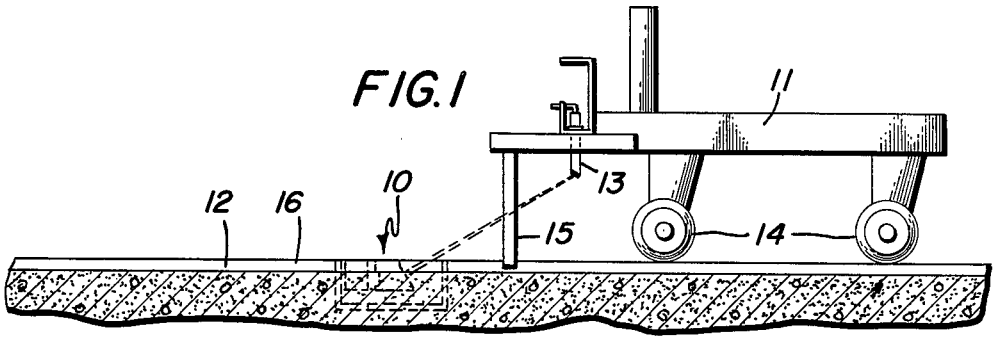

Referring first to FIG. 1, wherein are best shown the general features of the invention, the control unit, indicated generally by the reference numeral 10, is shown in use with a vehicle such as a tow truck 11 which is movable over a floor 12. The truck 11 carries a signal device 13 and has rubber-tired wheels 14 by which it moves over the floor 12. A guide rod 15 extends downwardly from the forward end of the truck and has a lower end which is carried in a guide or track 16 formed in the floor.

Figure 2:
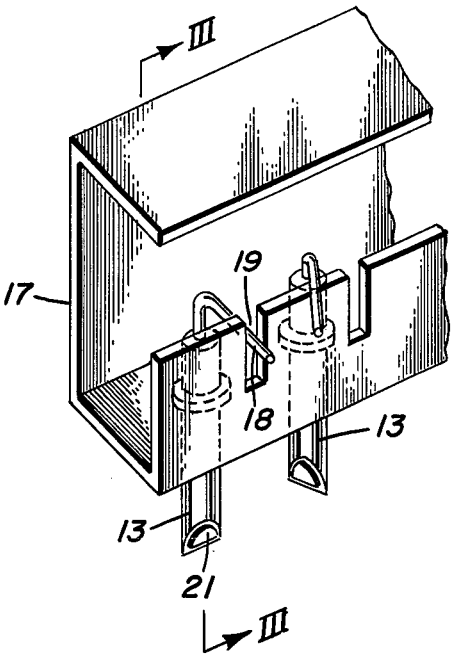
Figure 3:
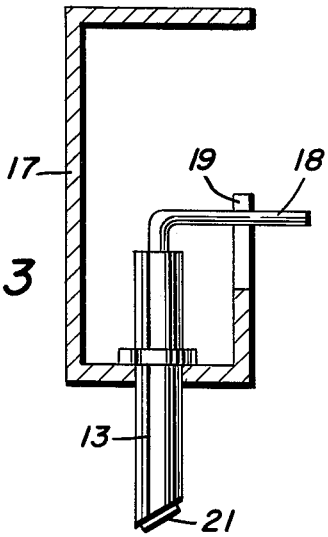

FIGS. 2 and 3 show the details of the signal device 13. It is provided with a mount 17 formed as a channel of sheet metal and the signal devices 13 are shown as generally cylindrical elements which are vertically slidable in apertures in the bottom of the mount and have a right angle rod 18 fitting on occasion on a notch 19 formed in a front wall of the mount. The lower end of each signal device is cut off at an angle of 40° and the resulting angled surface is provided with a plate 21 formed of a retro-reflective material. When the rod 18 lies in the notch 19, the retro-reflective material is directed at an angle of about 40° to the horizontal toward the floor 12. When the handle is lifted out of the notch and resides within the mount, the plate 21 is directed laterally of the tow truck.

Figure 4:
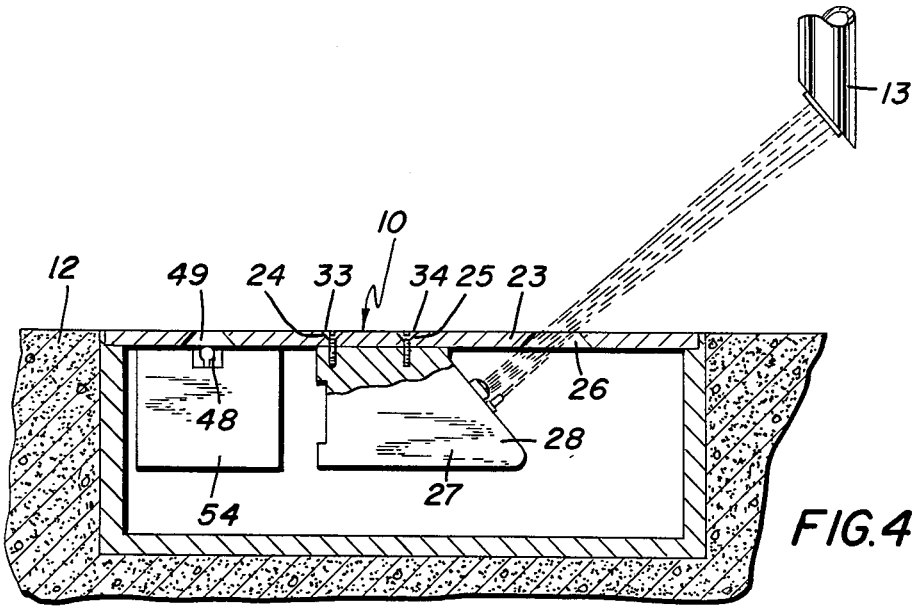
Figure 5:
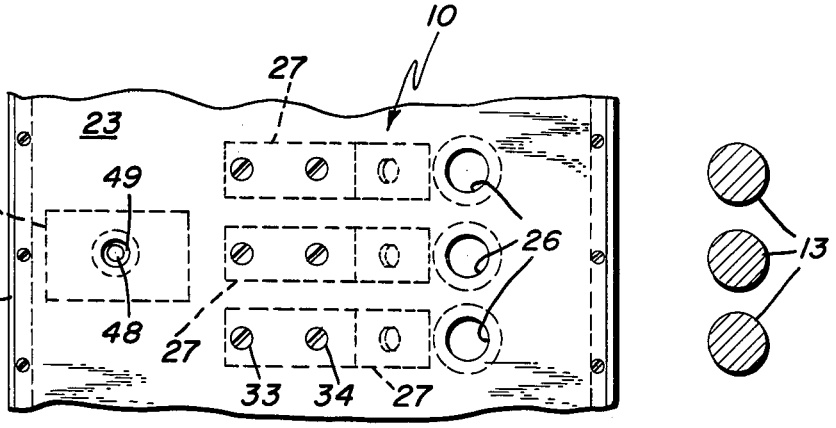

FIGS. 4 and 5 show further details of the scanner and associated equipment. A metal receptacle 22 is imbedded in the floor 12 which is shown as formed of poured concrete. A cover 23 is fixedly mounted on the receptacle by means of a accurately-formed groove or rabbet formed in the upper edge of the receptacle and by the use of screws. The cover is provided with three accurately-located apertures 24, 25, and 26 associated with each scanner 27. The scanner or sensor 27 includes a housing 28 which is mounted on the undersurface of the cover 23 and lies within the receptacle 22. Each sensor 27 includes a lense 29 which is accurately mounted with its axis in line with the aperture 26. The angle of the axis of the lense 29 is selected (as is evident in FIG. 4), so that the beam impinges on the retro-reflective plate 21 at a right angle. As is evident in FIG. 5, the aperture 26 is formed with a conical countersink on the underside of the cover 23. Also mounted on the undersurface of the cover 23 is an amplifier 54 having a pilot light 48 which is evident through an aperture 49 in the cover.

Figure 6:
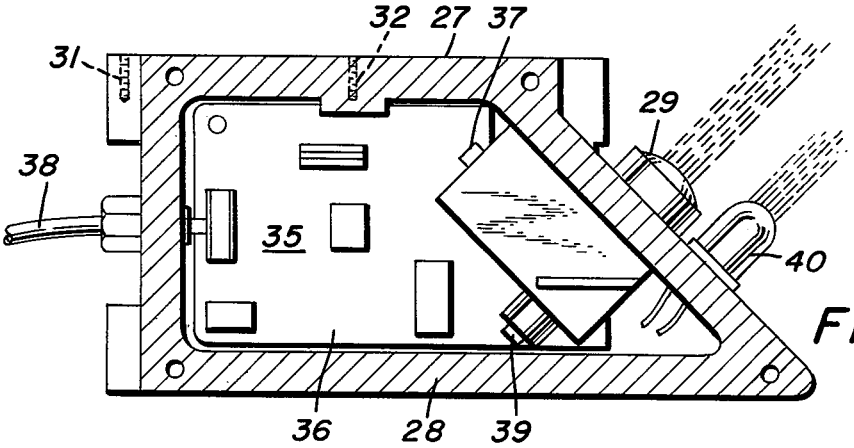

As is evident in FIG. 6, the upper part of the housing 28 of the sensor 27 is provided with a finely machined, flat surface through which extend fastening apertures 31 and 32. The sensor, therefore, is held tightly against the flat undersurface of the cover 23 (in a manner best shown in FIG. 4) by two threaded flat-head bolts 33 and 34 which lie in a countersunk portion of the apertures 24 and 25 in the cover. A generator 35 is mounted in a hollow interior formed in the housing 28 of the sensor and provides a modulated infra-red beam from the lense. When the light is returned to the scanner, the indicator light 40 indicates that the infra-red beam is inpinging on the reflector. Because it is otherwise dark within the receptacle 22, it is evident to the bystander when the pilot bulb 40 is energized because the glow emerges from the aperture 26.

In FIG. 6, the generator 35 is shown as consisting of a printed circuit 36 which fits snugly within the cavity in the housing and which carries solid state elements, including a light emitting diode 39, which is axially aligned with the lense 29, and a photo-transistor 37 which is also mounted adjacent the lense. The light emitting diode 39 and the photo-transistor 37 are interrelated with the lense 29 by a half-silvered mirror in the manner shown and described in the patent of Schwerdt et al. U.S. Pat. No. 3,214,596. A cable 38 is connected to the generator on one end and at the other end is connected to amplifier 54, as will be more fully described hereinafter.

Figure 7:
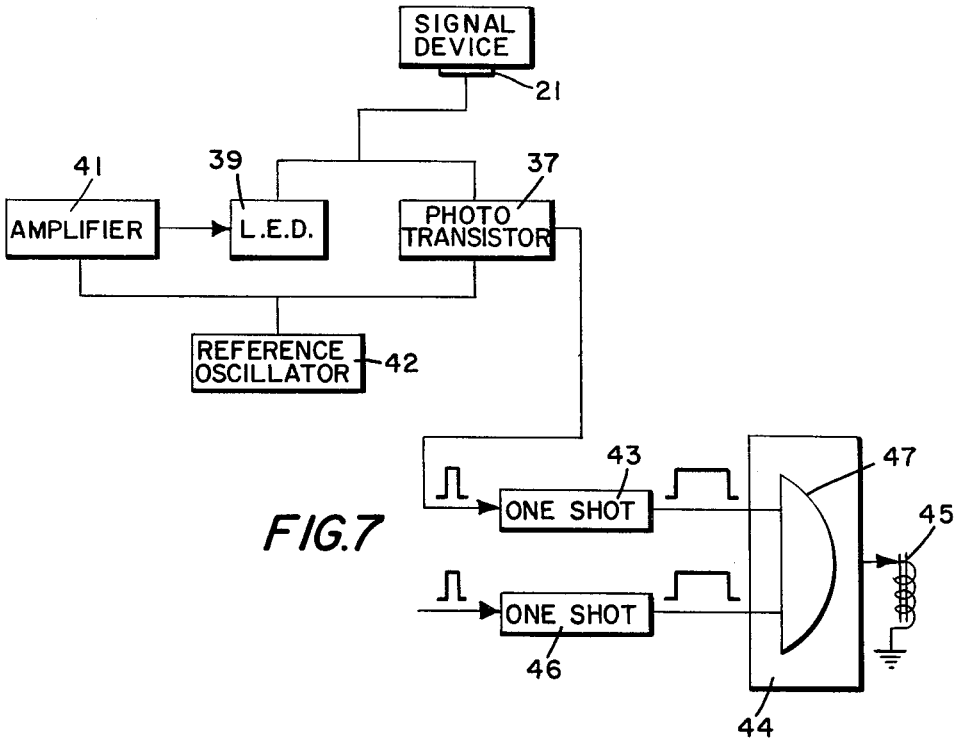

FIG. 7 shown in diagram form the manner in which the light emitting diode 39 and the photo-transistor 37 are related to other elements. An amplifier 41 sends a signal to the light emitting diode 39. The beam from the light emitting diode 39 is reflected from the plate 21 on the signal device and is returned to the photo-transistor 37. The amplifier and the photo-transistor 37 are both connected to a reference oscillator 42 to form a phase-locked loop in the manner shown and described in the patent of Dunigan U.S. Pat. No. 3,928,761. The output of the transistor 37 passes to a one shot 43 whose pulses are combined with a pulse from another one shot 46 in a gate 44. If the pulses from the one shot 43 and the one shot 46 are impressed on the input leads of the gate 44 at the same time, the pulse appears on the output gate, since the gate 44 is a "AND" gate. This pulse is impressed on a coil 45 of a relay which forms part of a diverting mechanism in the tow truck circuitry.

Figure 8:
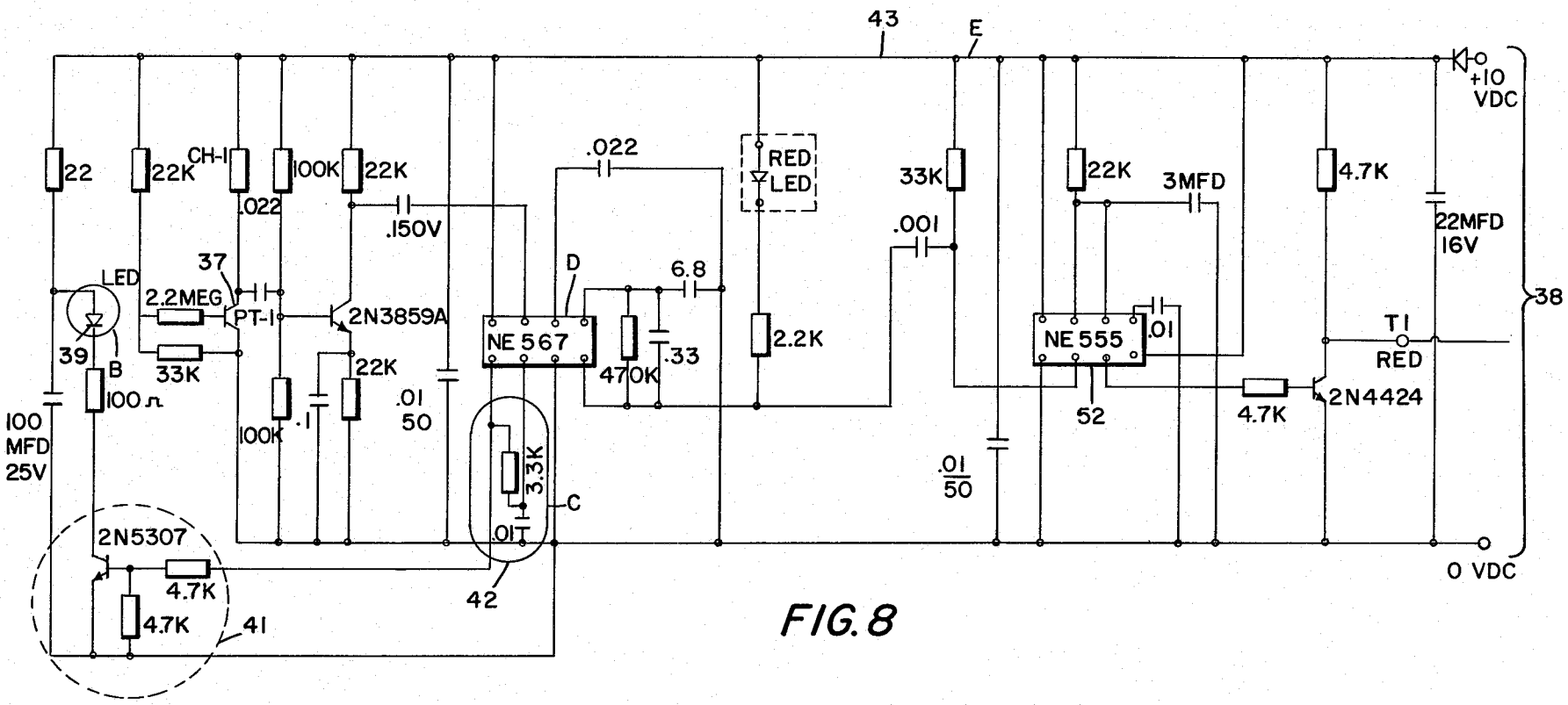

Referring to FIG. 7, it can be seen that the sensor includes amplifier 41 which serves the light emitting diode 39. The photo-transistor 37 is included in the circuitry and the amplifier 41 and the photo-transistor 37 are connected to a reference oscillator 42 from the phase-locked loop mentioned above. The circuitry includes also a logic chip 51 of the NE567 type. The photo-transistor is connected also to a one-shot circuit 42, see also FIG. 8, which includes a timing circuit in the form of a logic chip 52 of the NE555 type. The three leads leaving this circuitry make up the cable 38 leading to the amplifier 54.

Figure 9:
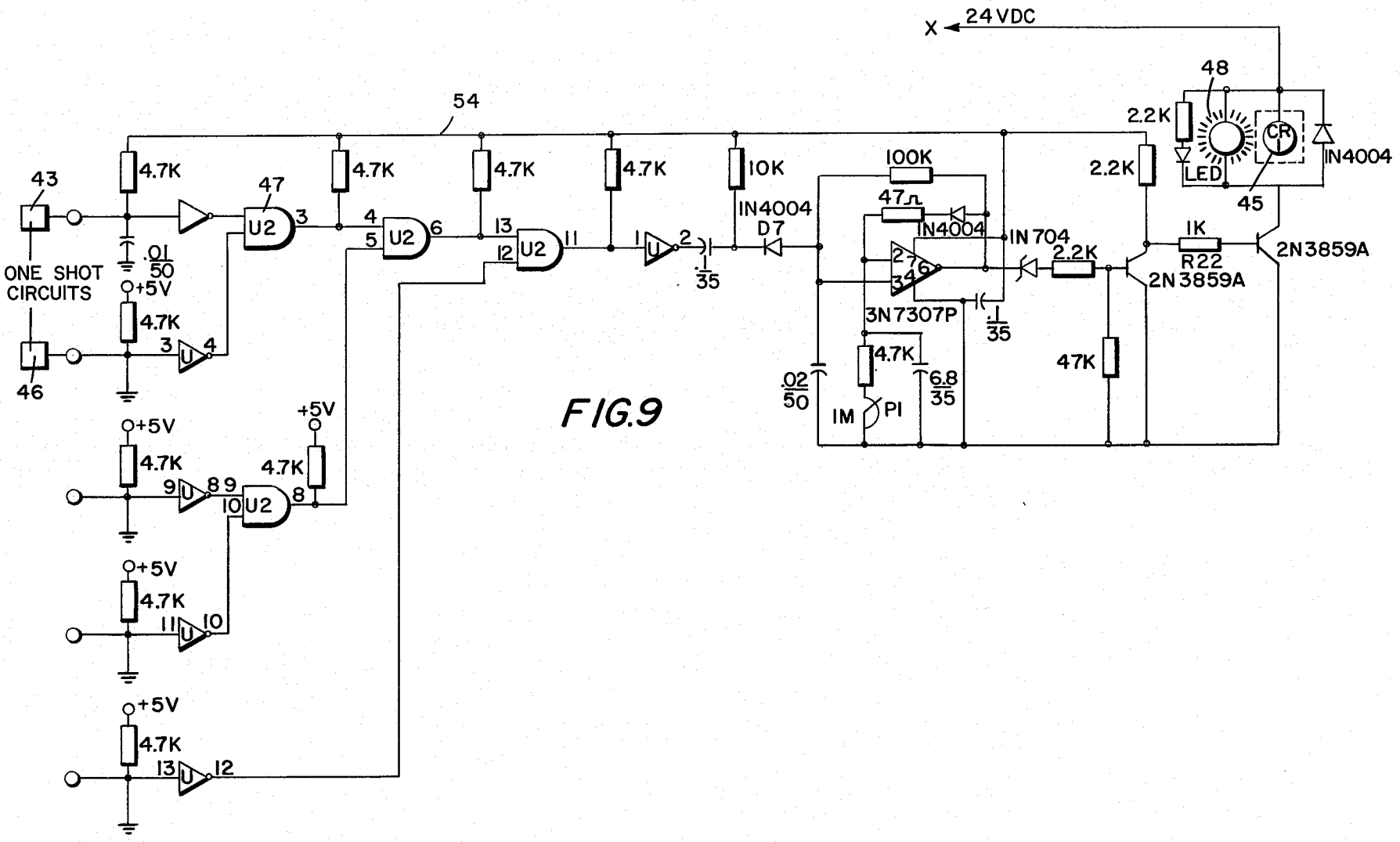

FIG. 9 is an electrical diagram of the amplifier 54 and shows that it includes a logic circuit whose output includes a relay 45 which effects a vehicle switch mechanism. It also includes a pilot light 48 as has been described in connection with FIGS. 4 and 5. Amplifier 54 includes an "AND" logic element 47 which is connected to the one-shot 43 of the circuitry associated with the sensor. It also receives a signal from a one shot 46 associated with another sensor. As is evident in the drawing, the amplifier 54 is set up to receive signals from any of a number of the sensors associated with the particular switching point and these are combined in the "AND" logic units to operate the relay 45 when the proper combination of pulses arrive simultaneously.

The operation and advantages of the present invention will now be readily understood in view of the above description. FIG. 1 has the tow truck 11 progressing to the left in the drawing and the guide rod 15 operating along the groove or guide 16 in the floor 12. When a decision point is reached, the tow truck approaches the vehicle control 10. This decision point is usually a switching point in which the guide 16 goes in one of the two directions and a switch is provided to cause the truck to go into one branch or the other, this switch being operated by the relay 45. The signal devices 13 are set up to indicate which branch is to be taken by the tow truck. In the described arrangement of the apparatus, two of the elements face in the "read" direction with their rods 18 lying in the notches 19. The rest of the elements have their rods in another direction, so that the retro-reflective plate 21 faces transversely of the tow truck direction.

Referring to FIG. 4 as the tow truck approaches the sensor 27, which is energized, the sensor projects a beam of infra-red energy toward the plate 21 and it is reflected back. The beam originates in the light emitting diode 39 and, if reflected back, is received by the photo-transistor 37. This eventually causes a pulse to arrive at the amplifier 54. If another signal device 31 is read by another sensor and these sensors correspond to the two sensors which serve the one shots 43 and 46, then the "AND" logic element 47 causes a pulse to reach the relay 45 and to actuate it. Because the opening 26 is provided with a conical countersink on the underside, it is possible to use an aperture opening at the upper part of a cover 23 that is the minimum size and, therefore, will cause the least cutting of the rubber wheels on the wheels 14 of the tow truck 11, furthermore, such a minimum size opening permits the minimum amount of dust to enter the receptacle 22 and to land on the lense 29. Such dust inhibits the beam projection; however, by the use of light at the infra-red end of the spectrum, the dust is most easily penetrated by the energy beam. The dust in the atmosphere tends to inhibit infra-red energy transmission the least of all of the frequencies of the spectrum available.

It should be noted from FIGS. 4, 5, and 6 that all of the sensors at a particular station are attached to the cover 23 at the factory. The cover is formed very accurately with respect to the openings 24, 25, and 26 associated with each sensor. The dimensions selected are such that, when the sensors are applied to the undersurface of the cover, they are automatically aligned in parallel relationship with one another and with the openings 26. Furthermore, if it is necessary to replace a sensor in the field, it is a simple matter of unfastening the cover, removing it, and using the apertures 24 and 25 to locate the new sensor which replaces the old one. In this way, the sensors are automatically located in the proper relationship even under the worst of conditions in the field. It is evident from the description that a single amplifier unit 54 is used for all of the sensors at a particular station. Provisions are made to receive signals from the one shot elements of five sensors, so that the combinations and permutations of the coding available on the signal devices 13 on the tow truck make possible a large number of final designations for the control of the tow truck. The pilot light 40 sends a glow through the opening 26, so that an observer standing beside the path of the tow truck can see if the sensor is in operation. In a similar way, the pilot light 48 shining through the opening 49 in the cover indicates to an observer if and when the relay 45 is actuated. This gives a check on the operation of the apparatus both during initial testing and during later checking of the operation of the apparatus. It is interesting to note that the light emitting diode 37 is a piece of solid state apparatus that does not include filaments which can be rendered inoperative by vibration in the warehouse. In this way, the likelihood of it becoming inoperative is greatly reduced. Furthermore, all of the generator and amplifier equipment associated with the lamp is also of a solid state nature, so that it is not likely that vibration will present a problem. It should be noted that the use of retro-reflective signal devices on the tow truck permits the scanner to operate effectively despite changes in the physical relationship of the tow truck to the floor; for instance, when the wheels wear or if they bounce over an obstruction on the floor at the time when it is necessary to read the code, the control will still operate. This is because the retro-reflective material actually reflects even though the angle between the beam and the surface of the retro-reflective plate is not exactly a right angle. Also, when an infra-red beam is used for sensing, the result is that ambient light that finds its way into the receptacle will not give a false reading in the equipment. It can be seen, therefore, that by use of the present equipment some of the problems of the use of retro-reflective pattern coding are overcome. The presence of dust is less of a problem, as is the presence of ambient light. Any vibration will not be a problem and the difficulty of field installation and maintenance is substantially lessened.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Vehicle control system for use with a vehicle movable over a floor and carrying a signal device, comprising:

(a) a receptacle adapted to be embedded in the floor,
(b) a cover fixedly mounted on the receptacle and having an aperture,
(c) a sensor including a housing mounted on the undersurface of the cover and lying with the receptacle and including a lens mounted with its axis in line with said aperture and a photo-transistor,
(d) a generator mounted within the sensor housing and including an amplifier and a light-emitting diode connected to said amplifier for producing a modulated light beam from the lens,
(e) a reference oscillator connected to said amplifier and photo-transistor to form a phase-locked loop,
(f) a vehicle switch mechanism, and
(g) a one-shot circuit fed by said photo-transistor and which includes a relay for controlling said switch.

2. Vehicle control system for use with a vehicle movable over a floor and carrying a signal device, comprising:

(a) a receptacle adapted to be embedded in the floor,
(b) a cover fixedly mounted on the receptacle and having an aperture,
(c) a sensor including a housing mounted on the undersurface of said cover and lying within said receptacle and including a photo-transistor, and a lens mounted with its axis in line with said aperture,
(d) a generator mounted within said sensor housing and including a light-emitting diode for providing a modulated infra-red light beam from said lens, a tuned amplifier connected to said photo-transistor, said amplifier being sensitive to signal phase and frequency,
(e) an "AND" gate logic element for operating a relay which controls a vehicle switch, and
(f) a one-shot circuit connected to said amplifier whose output is fed into said "AND" gate logic element.

3. Vehicle control system for use with a vehicle movable over a floor and carrying a signal device, comprising:

(a) a receptacle adapted to be embedded in the floor,
(b) a cover fixedly mounted on the receptacle, the cover having three accurately-located apertures, one end of which is a circular hole with a conical countersink on the undersurface of the cover,
(c) a sensor including a housing mounted on the undersurface of the cover and lying within the receptacle and including a lens mounted with its axis in line with said one aperture, the housing having two apertures which cooperate with the other two apertures in the cover for mounting, and
(d) a generator mounted within the sensor housing and providing a modulated light beam at the infra-red end of the spectrum from the lens.

4. Vehicle control system as recited in claim 1, wherein said generator comprises solid state means including a diode for providing said modulated light.

5. Vehicle control system as recited in claim 4, wherein the sensor includes a tuned amplifier which upon receipt of a predetermined frequency operates a relay.

6. Vehicle control system as recited in claim 3, wherein the generator includes an amplifier serving a light-emitting diode, and wherein the sensor includes a photo-transistor, the amplifier and the photo-transistor being connected to a reference oscillator to form a phase-locked loop.

7. Vehicle control system as recited in claim 6, wherein the photo-transistor feeds into a one-shot circuit whose output includes a relay which effects a vehicle switch mechanism.

8. Vehicle control system as recited in claim 7, wherein the logic circuit includes an "AND" logic element that receives the pulse from the one shot an one input lead and receives a pulse from another one shot an another input lead, a coincidence of pulses causing energization of the said relay.

9. Vehicle control system as recited in claim 6, wherein the amplifier is fastened to the undersurface of the cover, wherein the amplifier has a pilot light that is energized when the amplifier issues a signal, and wherein an aperture is provided in the cover in registry with the pilot light.

10. Vehicle controlled system for use with a vehicle movable over a floor and carrying a signal device, comprising:

(a) a receptacle adapted to be embedded in the floor, (b) a cover fixedly mounted on the receptacle and having a circular hole with a conical countersink on the undersurface of the cover, (c) a sensor including a housing mounted on the undersurface of the cover and lying within the receptacle and including a lens mounted with its axis in line with said hole in the cover, and (d) a generator mounted within the sensor housing and including a light emitting diode for providing a modulated light beam.

* * * * *